US005454219A

United States Patent [19]

Raasch

[11] Patent Number: 5,454,219

[45] Date of Patent: Oct. 3, 1995

[54] MEANS FOR PROVIDING AIR FLOW IN A TRASH REMOVAL CHAMBER OF AN OPEN-END SPINNING UNIT

[75] Inventor: Hans Raasch, Mohchen-Gladbach, Germany

[73] Assignee: W. Schlafhorst AG & Co., Monchen-Gladbach, Germany

[21] Appl. No.: 210,932

[22] Filed: Mar. 21, 1994

[30] Foreign Application Priority Data

Apr. 2, 1993 [DE] Germany ..... 43 10 810.5

[51] Int. Cl.[6] ..... D01H 11/00; D01H 13/26

[52] U.S. Cl. ..... 57/304; 57/301; 57/406; 57/407; 57/412

[58] Field of Search ..... 57/301, 304, 406, 57/407, 412; 15/345, 301; 19/200, 303

[56] References Cited

U.S. PATENT DOCUMENTS

| | | | |
|---|---|---|---|
| 3,360,917 | 2/1968 | Kubovy et al. | 57/301 |
| 3,792,575 | 2/1974 | Doudlebsky et al. | 57/301 |
| 3,922,839 | 12/1975 | Sakurai et al. | 57/301 |
| 4,036,002 | 7/1977 | Kobayashi | 57/301 |
| 4,038,812 | 8/1977 | Stahlecker | 57/301 |
| 4,204,393 | 5/1980 | Miyazaki et al. | 57/301 |
| 4,249,370 | 2/1981 | Vecera et al. | 57/301 |
| 4,499,718 | 2/1985 | Junek et al. | 57/301 |
| 4,505,101 | 3/1985 | Kurushima et al. | 57/301 |

FOREIGN PATENT DOCUMENTS

| | | |
|---|---|---|
| 2458538A1 | 6/1976 | Germany . |
| 2856058A1 | 7/1979 | Germany . |
| 4229144A1 | 3/1994 | Germany . |

*Primary Examiner*—Daniel P. Stodola
*Assistant Examiner*—William Stryjewski
*Attorney, Agent, or Firm*—Shefte, Pinckney & Sawyer

[57] ABSTRACT

A housing encloses a rotor, an opening roller, and a conduit communicating between the rotor and opening roller for the feeding of fiber from the opening roller to the rotor. The housing forms a trash removal chamber below the opening roller into which trash is discharged toward the bottom of the chamber during operation of the opening roller; the area of the opening roller where the trash is discharged is the trash outlet opening. The rotation of the opening roller creates an air flow draft in the direction of rotation. This air flow draft, taken in combination with suction applied in the rotor of the open-end spinning unit, creates an air flow suction draft from the chamber through the conduit in the direction of the opening roller rotation. An air flow is provided in the trash removal chamber in and from the chamber in a direction counter to the direction of the air flow draft rotating with the opening roller in the region of the trash outlet opening. A second air flow is also provided in the chamber for flow to and with the air flow suction draft.

12 Claims, 4 Drawing Sheets

MEANS FOR PROVIDING AIR FLOW IN A TRASH REMOVAL CHAMBER OF AN OPEN-END SPINNING UNIT

BACKGROUND OF THE INVENTION

The present invention relates to an open-end spinning unit and more particularly to removal of trash within such unit.

In operation of open-end spinning units the initial separation of fibers from a sliver-by an opening roll results in separation of trash which must be removed. This removal of trash has been the subject of concern for those of skill in the art.

Typically, in open-end spinning units such as that disclosed in DE 28 56 028A, sliver is fed between a fiber draw-in roller and a feed plate to an opening roller that separates and combs the fibers and causes trash to separate by centrifugal force and fall by gravity into a trash collection chamber below the opening roller. In this transport, both the fibers and the trash particles are rapidly accelerated to approximately the circumferential speed of the opening roller by rotation of the opening roller and the circulating air flow draft created by the rotation of the roller and the suction induced in the downstream rotor of the spinning unit. Because of the centrifugal force acting upon them, fibers and trash particles, have the tendency to fly off the roller at a tangent when there is no constraining housing adjacent the roller as happens in the region of the outlet opening into the trash collection chamber.

To prevent spinnable fibers from flying away from the opening roller at the trash collection chamber along with the trash particles, an aspiration opening an air inlet is provided in the trash collection chamber for air flow to the opening roller to maintain the fibers, which have a slight mass in proportion to their surface area, firmly against the opening roller in the manner of a pneumatic guide. On the other hand, the trash particles which have a greater mass in proportion to their surface area developed a markedly higher kinetic energy, overcoming this air flow and separated centrifugally from the opening roller to fall into the trash collection chamber.

The trash particles are then subjected to a further air flow for removal through a suction discharge opening. The trash collection chamber may be provided with an air baffle, which is located a slight distance from the trash discharge opening and divides the chamber into a trash separation zone and a trash removal zone. However, this results in only partial separation of the air flows, which are in the same direction, with some fibers remaining in the particle flow and some of the trash particles remaining in the fiber flow.

Since the air baffle is not easily accessible and is therefore difficult to clean, in such an arrangement the disadvantage also exists that deposits of trash particles will occur at the air baffle over time, which has a negative impact on air flow conditions within the spinning unit.

Thus, an important element with a view to satisfactory processing of fiber materials is the separation of the trash at the opening roller housing of a rotor spinning machine. Although the technology of trash separation devices appears relatively simple, these devices are in fact quite problematic and react sensitively to changes. Even slight modifications in trash separation, for instance as a result of trash deposits, can therefore affect the results not only in terms of the quantity of trash removed but can affect the overall outcome of spinning as well.

From German patent DE 42 29 144A1, an open-end spinning unit is also known that substantially comprises a basic housing that accommodates a sliver feed device, an opening roller housing and a rotor housing. This spinning unit has a hinged cover for closing the rotor housing and a conduit plate that has at least a part of a fiber guide conduit and a yarn draw-off conduit. In the region of the basic housing, a trash collection chamber is disposed below the opening roller housing to receive the trash particles combed out of the sliver by the opening roller. The trash chamber is connected to a suction device of the spinning unit itself, via suction connection while the spinning machine itself, via a suction connection. While effective, further increase in the quality of trash separation and removal has been desired.

SUMMARY OF THE INVENTION

The object of the invention is to improve the function of the trash separation region of open-end spinning units.

This and other objects of the present invention are accomplished in an open-end spinning unit having a housing enclosing a rotor, an opening roller and a fiber guide conduit communicating between the rotor and opening roller for the feeding of fiber from the opening roller to the rotor, and forming a trash removal chamber below the opening roller and into which trash is discharged toward the bottom of the chamber during operation of the opening roller, and wherein the rotation of the opening roller in combination with suction applied in the rotor of the open-end spinning unit creates an air flow suction draft from the chamber through the conduit in the direction of the opening roller rotation, wherein means for providing air flow in the trash removal chamber includes means for providing a trash removal air flow in and from the chamber in a direction counter to an air flow draft rotating with the opening roller in the region of the trash outlet opening and a means for introducing an air flow into the chamber for flow to and with the air flow suction draft.

The means for providing a trash removal air flow may include a trash discharge opening in the housing communicating with said chamber and connected to a suction device, and a trash removal air flow inlet opening in the housing communicating with the chamber for entry of air forming the trash removal air flow in the chamber to the trash discharge opening. The trash removal air flow inlet opening is preferably spaced from the trash discharge opening in the direction the opening roller rotates at the chamber, and the device for introducing an air flow to and with the suction draft includes a suction draft air flow inlet opening in the housing communicating with the chamber and being spaced from the trash removal air flow inlet opening in the direction the opening roller rotates at the chamber.

The housing may have a forward wall, with respect to the direction of rotation of the opening roller at the chamber, and side walls extending rearwardly from the forward wall. The trash removal air flow inlet opening may be disposed in one of the side walls intermediate the trash discharge opening and the suction draft air flow inlet opening. The suction air flow inlet opening may be formed in a forward wall of the housing. The trash removal air flow inlet opening may be in the form of a laterally elongated slot, and an air and trash baffle may be disposed in the chamber below the elongated slot and extending from below the slot to adjacent the trash discharge opening. The inlet openings may communicate with the atmosphere. The side walls may comprise a back side wall and a front side wall, the front side wall being in the form of an openable front cover to permit access to the chamber, and the trash removal air flow inlet opening may be formed in one of the walls. Alternatively, the trash removal air flow inlet opening may be formed in the back side wall. The trash removal air flow inlet opening may be formed in the front cover. A trash removal air flow conduit may be provided extending from the trash discharge opening to suction means, with releasable sealing means sealing the trash discharge opening to the conduit. The housing may have a wall in the form of an openable cover for the chamber and may have a service opening therein for introducing an external suction cleaning device.

Further details of the invention are disclosed in the following detailed description of the preferred embodiment of the present invention and as illustrated in the accompanying drawings.

DESCRIPTION OF THE PREFERRED EMBODIMENT

Figure 1:
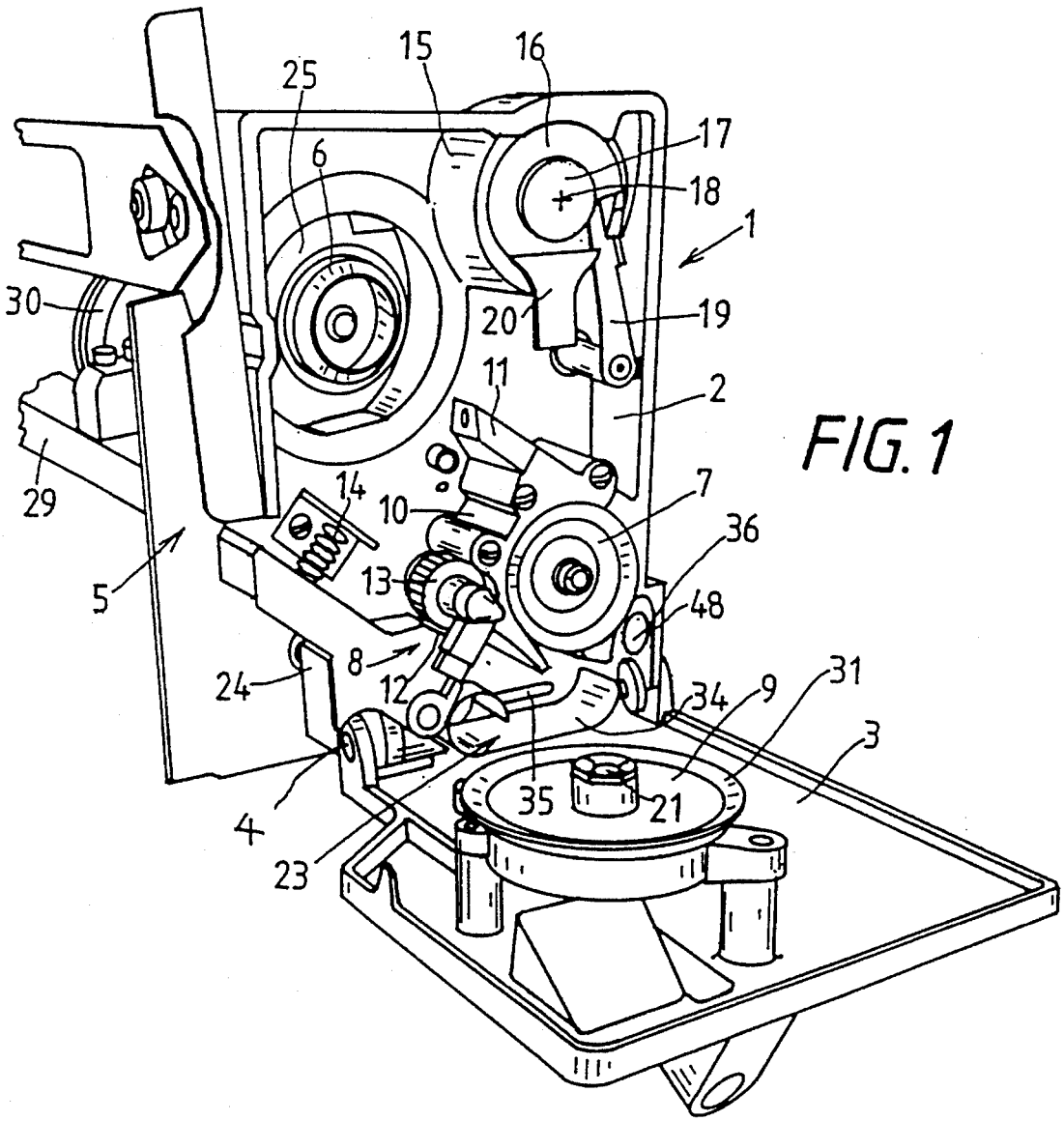
FIG. 1 is a perspective view of an open-end spinning unit incorporating the preferred embodiment of the means for providing air flow in a trash removal chamber of a open-end spinning unit of the present invention.

In FIG. 1, an open-end spinning unit 1 is shown. The spinning unit 1 has a basic housing 2 and a cover 3 that can be swung open about a pivot shaft 4 and that in the closed state is secured by a locking device 5.

A spinning rotor 6 is disposed in the basic housing 2, inside a rotor housing 25. The spinning rotor 6 is supported by its rotor shaft, in a known manner, on support disks 30 that are secured to a bearing bracket 29 located on the end of the housing. The rotor housing 25 communicates via an air conduit 26 with a bearing housing 15 disposed laterally and vertically offset. An eccentric element 16 is disposed inside the bearing housing 15 on a bearing bolt 17 and is adjustable by means of a pivot lever 20 and axially secured by a stop 19.

Also disposed in the basic housing 2, below the pivot axis 18 and offset somewhat toward the middle from it is an opening roller housing 10, onto which part the fiber guide conduit 11 is formed. An opening roller 7 rotates in the opening roller housing 10 and opens a sliver 28, presented by a sliver feed device 8, into individual fibers. The sliver feed device 8 comprises a sliver feed roller 13 and a pressure plate 12, with a sliver inlet funnel 24 which may be formed in the housing. The pressure plate 12 is positioned against the sliver feed roller 13 by a spring element 14.

Located in the front wall 3 of the spinning unit 1 is a top plate 9, which with a seal 31 closes off the front of the rotor housing in an airtight fashion. The conduit plate 9 also has a centrally disposed yarn draw-off nozzle 21 and the remainder of the fiber guide conduit 11. The front wall is preferably an openable front cover.

Figure 2:
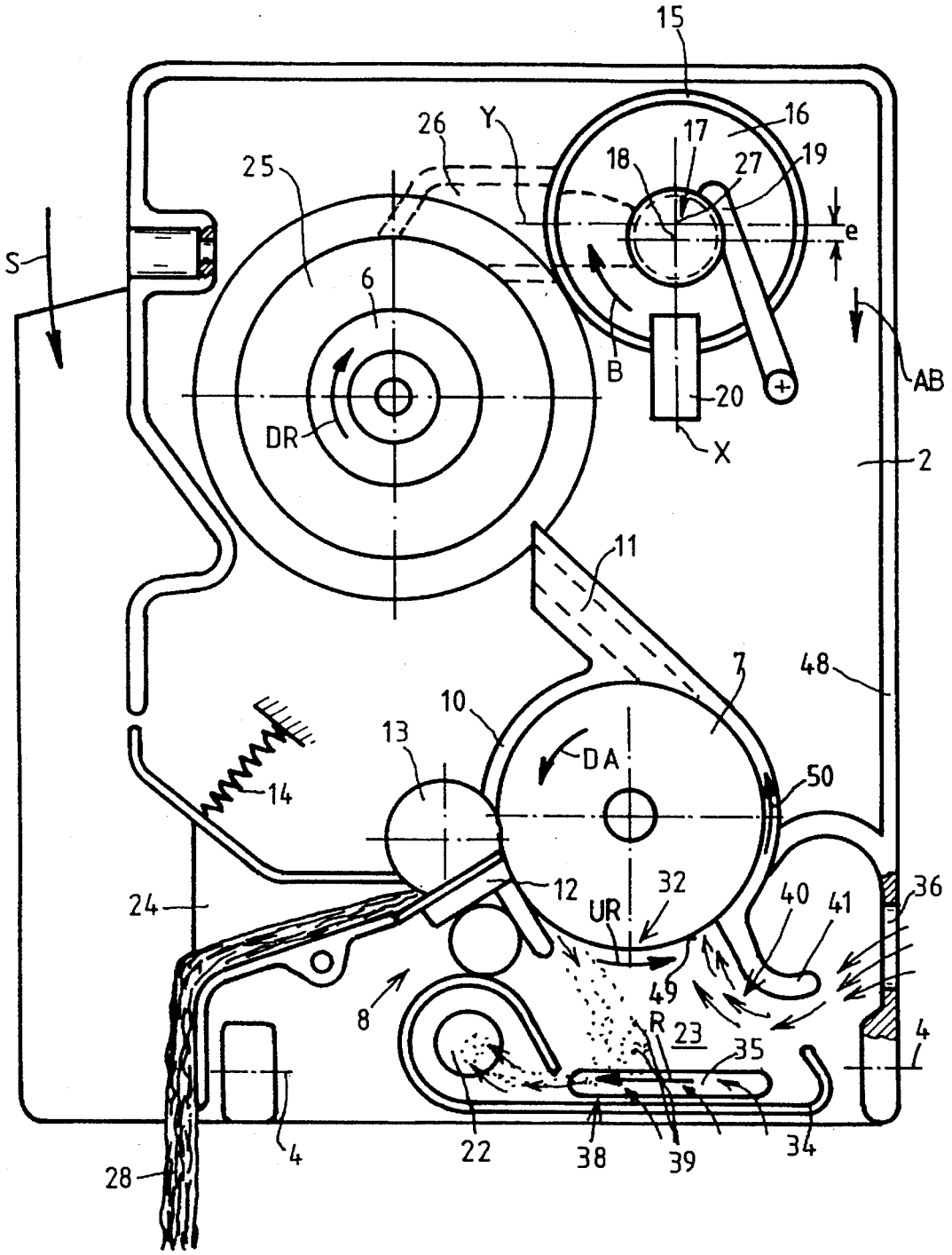
FIG. 2 is a vertical sectional view of the open-end spinning unit illustrated in FIG. 1.

As indicated in FIG. 2, the spinning unit 1 can be pivoted out of the way in the direction S. The pivot axis 18 is formed by the bearing bolt 17, on which the bearing housing 15 is supported via the eccentric element 16. The eccentric element 16, which has the eccentricity e, can be adjusted between two basic positions X and Y by means of a pivot lever 20. By pivoting the eccentric element 16 in the direction B, the spinning unit 1 is lowered in the direction AB and in this position, after separation of the stop 19, can be completely removed from the spinning machine frame to the front. The rotor housing 25, in which the spinning rotor 6 rotates in the direction DR, is as already mentioned above, connected via an air conduit 26 to the bearing housing 15, or via an air nozzle 27, located in the bearing bolt 17 formed as a bearing tube, to a suction device of the unit itself, and is closed off at the front in an airtight manner by the conduit plate 9 disposed in the front wall 3.

The opening roller housing 10 is disposed below the rotor housing 25 and offset somewhat laterally; it has part of the fiber guide conduit 11 and a trash outlet opening 32. The trash outlet opening 32 discharges into a trash chamber 23, whose outer contours are partially formed by an air and trash baffle 34. The trash chamber 23 has an opening 22 for trash discharge by suction, a suction draft air flow inlet 35, and an air inlet opening 36. The trash suction discharge opening 22 is connected to a negative pressure source 45 via a suction air flow conduit 37 and a filter element 33, while the suction air flow inlet 35 and the air inlet opening 36 communicate with the atmosphere.

Between the trash removal air flow opening 35 and the trash discharge opening 22, the negative pressure present at the trash discharge opening 22 causes a transporting air flow 38, acting in the direction of the trash discharge opening 22, which receives and disposes of the trash particles 39 that have come loose of the opening roller 7 under the influence of centrifugal force and gravity. The transporting air flow 38 is counter to the draft 50 that revolves with the opening roller 7.

Since the negative pressure necessary in the rotor housing 25 in order to maintain a proper spinning process is effective via the fiber guide conduit 11 all the way into the region of the opening roller 7, and moreover is further reinforced by the negative pressure that arises at the surface of the rotating opening roller 7 because of the draft 50, a flow of suction 40 effective in the direction of the opening roller 7 builds up between the air inlet opening 36 and opening roller surface 49. This suction flow 40 forms a "quasi-pneumatic guide" in the region of the trash outlet opening 32 of the opening roller housing 10, and this keeps the spinnable fibers firmly against the opening roller surface for ultimate transport to the rotor. Because of their greater kinetic energy, however, the trash particles 39 penetrate this suction flow 40 and are extracted by suction by the transporting air flow 38.

As indicated in FIG. 2, this arrangement of suction air flow inlet 35 and trash discharge opening 22 results in maximal separation of the flow systems 38 and 40, without incorporating partitions or the like, which are vulnerable to trash accumulation.

The invention has the advantage that the separation of the various air flows takes place maximally within the trash collection chamber 23. A relatively pronounced negative pressure is present at the trash discharge opening 22 and provides for an adequate air flow for transporting the trash particles away. This air flow, which is counter to the air flow draft rotating with the opening roller in the region of the trash outlet opening 32 of the opening roller housing does not adversely affect the spinning process.

The negative suction occurring in the region of the opening roller surface, which arises both from the pressure in the rotor housing that is required for the spinning process and from the fiber transport flow at the rotating opening roller, creates a separate suction, which draws air in the chamber via a lateral trash removal air inlet opening 36.

In a preferred embodiment, the trash discharge opening 22 and the trash removal air inlet opening 36 are offset with respect to a vertical center plane in the trash collection chamber, and the central suction draft air flow inlet 35 is disposed in the lower region of the chamber. The disposition of the various openings is chosen to be such that the suction draft air flow inlet 35 for the transporting air flow is located approximately centrally between the trash discharge opening 22 and the trash removal air inlet opening 36, preferably in a side wall of the spinning unit. In combination with the air and trash baffle 34 that forms the lower outer wall of the trash chamber, such an embodiment results in essentially separate air flows inside the trash chamber 23. The relatively strong transporting air flow operative in the region below the trash outlet opening of the opening roller housing assures proper disposal of the trash particles, while the suction entering the side wall of the spinning unit via the trash removal air inlet opening 36 becomes operative as a "pneumatic guide" of the individual fibers on the opening roller.

Figure 3:
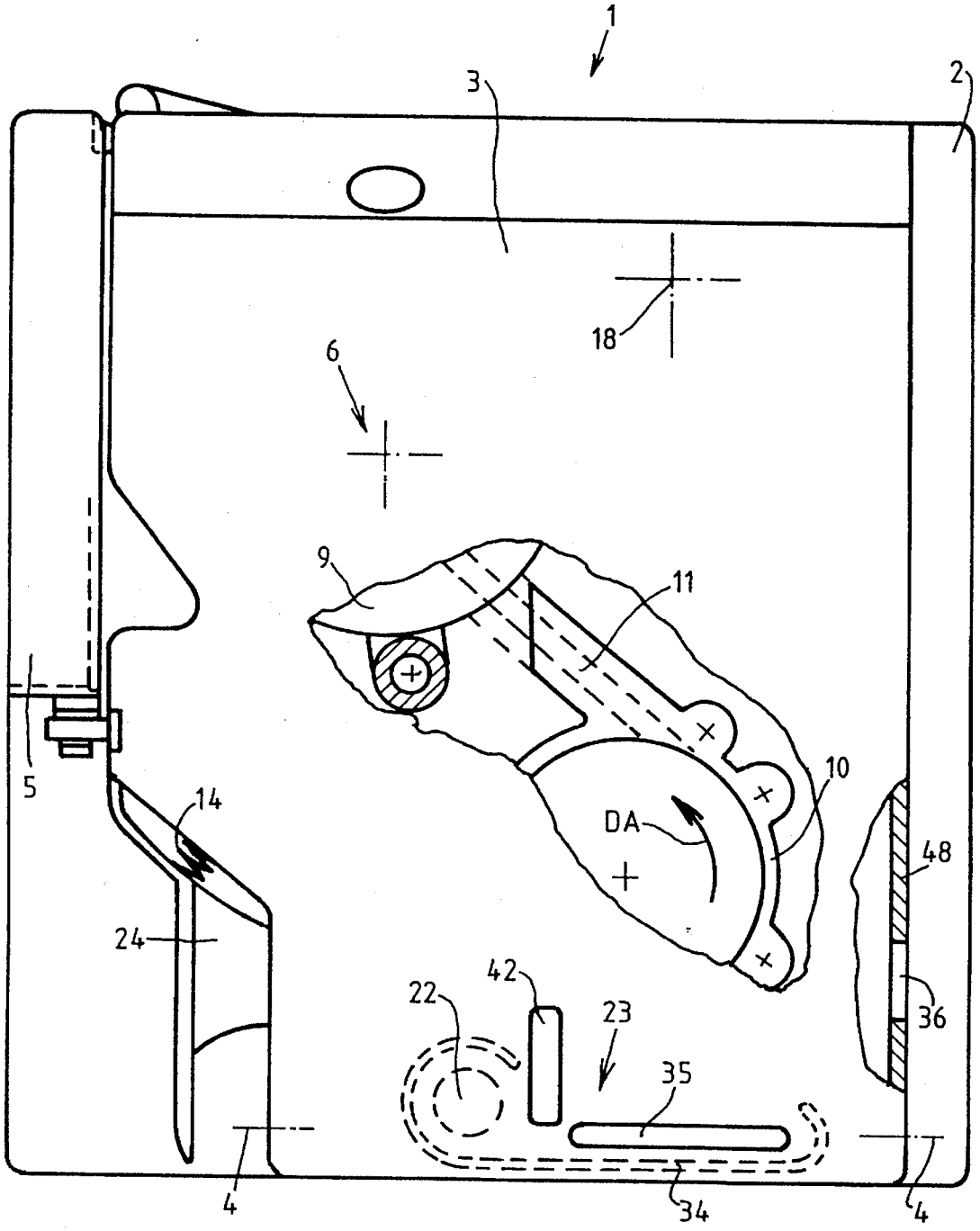
FIG. 3 is a front elevational view of the open-end spinning unit of FIG. 1, partially broken away.
Figure 4:
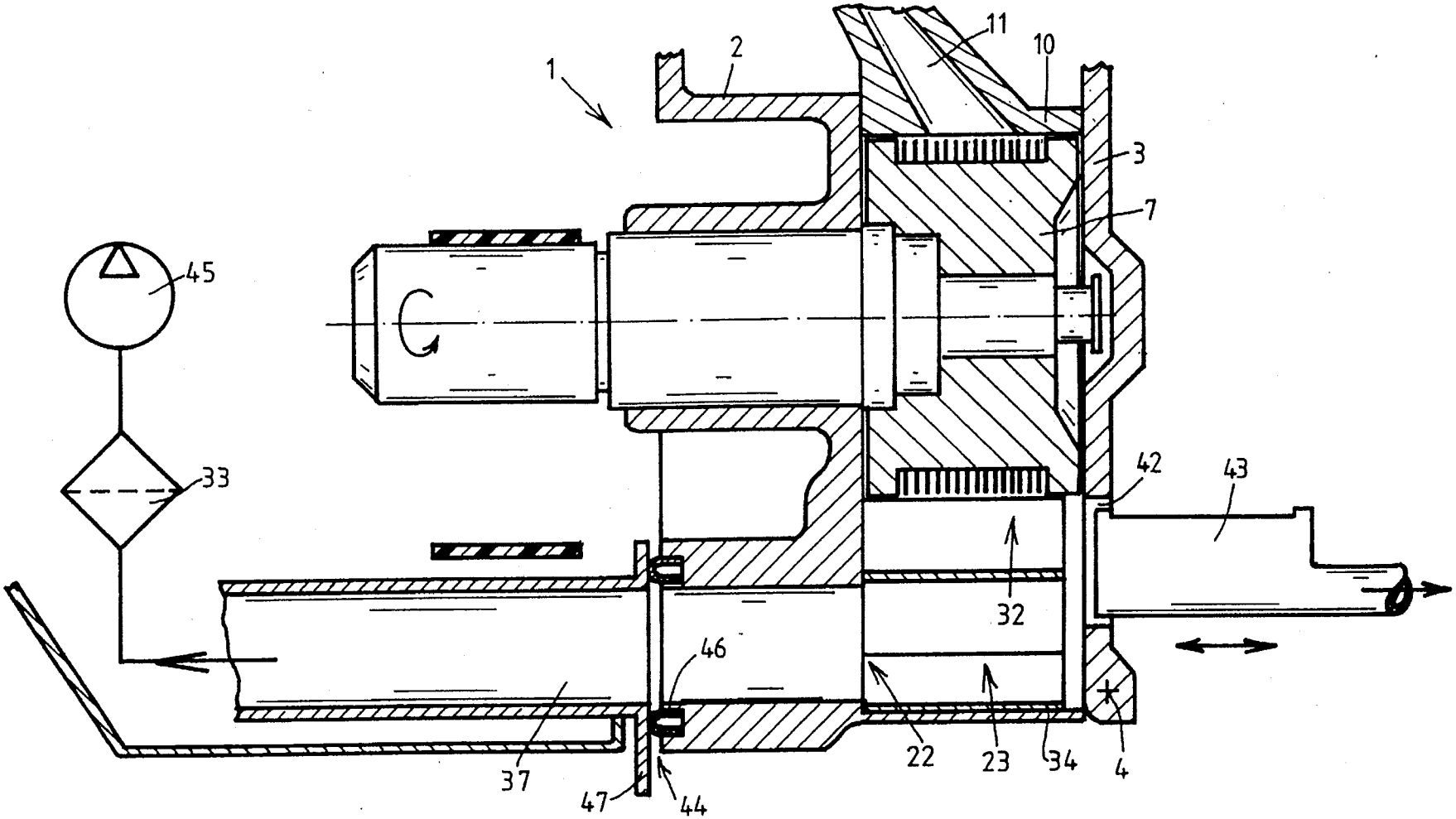
FIG. 4 is a vertical sectional view of the open-end spinning unit of FIG. 3.

FIGS. 3 and 4 show further embodiments and features of the invention. The trash removal air opening 35, which in the exemplary embodiment of FIG. 2 is an oblong slot or longitudinal gap and is located in the back wall of the basic housing 2, may alternatively be located in the front cover 3 of the spinning unit 1. Also, formed in the front cover 3 is an optionally closable service opening 42, into which a suction tool 43 can be introduced. This suction tool 43, which may be disposed on a service carriage, such as an automatic yarn piecing unit, is introduced into the trash chamber 23 in the re-piecing process and, positioned directly below the opening roller 7, to extract fibers by suction during the preparation of the silver for start-up of the machine.

FIG. 4 shows a possible embodiment of a swivelable pneumatic connection of the trash collection chamber 23 to the negative pressure source 45. An annular sealing element 46 is disposed in the rearward region of the dirt extraction opening 22. It corresponds directly to a relatively large area sealing plate 47, which is part of a trash removal air flow conduit 37, which communicates with the negative pressure source 45 via filter element 33.

The trash collection chamber according to the invention offers advantages not only in terms of the functioning of such spinning units, but it is also designed for easy maintenance, which is particularly desirable in an automatic spinning operation.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an open-end spinning unit having a housing enclosing a rotor, an opening roller, and a conduit communicating between the rotor and opening roller for the feeding of fiber from the opening roller to the rotor, and forming a trash removal chamber below the opening roller and into which trash is discharged toward the bottom of the chamber during operation of the opening roller, and wherein the rotation of the opening roller creates an air flow draft in the direction of rotation that, in combination with suction applied in the rotor of the open-end spinning unit, creates an air flow suction draft from the chamber .through the conduit in the direction of the opening roller rotation, means for providing air flow in said trash removal chamber comprising:

(a) means for providing a trash removal air flow in and from said chamber in a direction counter to the air flow draft rotating with the opening roller in the region of the trash outlet opening; and (b) means for introducing an air flow into said chamber for flow to and with the air flow suction draft.

2. In an open-end spinning unit, means providing air flow in a trash removal chamber according to claim 1 and characterized further in that said means for providing a trash removal air flow comprises a trash discharge opening in said housing communicating with said chamber and connected to suction means, and a trash removal air flow inlet opening in said housing communicating with said chamber for entry of air forming the trash removal air flow in said chamber to said trash discharge opening, said trash removal air flow inlet opening being spaced from said trash discharge opening in the direction the opening roller rotates at said chamber, and said means for introducing an air flow to and with the suction draft comprises a suction draft air flow inlet opening in said housing communicating with said chamber and being spaced from said trash removal air flow inlet opening in the direction the opening roller rotates at said chamber.

3. In an open-end spinning unit, means providing air flow in a trash removal chamber according to claim 2 in that said housing has a forward wall, with respect to the direction of rotation of the opening roller at the chamber, and side walls extending rearwardly from said forward wall, and wherein said trash removal air flow inlet opening is disposed in one of said side walls intermediate said trash discharge opening and said suction draft air flow inlet opening.

4. In an open-end spinning unit, means providing air flow in a trash removal chamber according to claim 3, wherein said suction air flow inlet opening is formed in said forward wall.

5. In an open-end spinning unit, means providing air flow in a trash removal chamber according to claim 3 in that said trash removal air flow inlet opening is in the form of a laterally elongated slot.

6. In an open-end spinning unit, means providing air flow in a trash removal chamber according to claim 5 by an air and trash baffle disposed in said chamber below said elongated slot and extending from below said slot to adjacent said trash discharge opening.

7. In an open-end spinning unit, means providing air flow in a trash removal chamber according to claim 3 in that said side walls comprise a back side wall and a front side wall, said front side wall being in the form of an openable front cover to permit access to said chamber, and said trash removal air flow inlet opening is formed in one of said walls.

8. In an open-end spinning unit, means providing air flow in a trash removal chamber according to claim 8 in that said trash removal air flow inlet opening is formed in said back side wall.

9. In an open-end spinning unit, means providing air flow in a trash removal chamber according to claim 8 in that said trash removal air flow inlet opening is formed in said front cover.

10. In an open-end spinning unit, means providing air flow in a trash removal chamber according to claim 2 in that said inlet openings communicate with the atmosphere.

11. In an open-end spinning unit, means providing air flow in a trash removal chamber according to claim 2 by a trash removal air flow conduit extending from said trash discharge opening to said suction means, and releasable sealing means sealing said trash discharge opening to said conduit.

12. In an open-end spinning unit, means providing air flow in a trash removal chamber according to claim 1 wherein said housing has a wall in the form of an openable cover for said chamber and having a service opening therein for introducing an external suction cleaning device.

* * * * *